US012520942B1

(12) United States Patent
Zhang

(10) Patent No.: US 12,520,942 B1
(45) Date of Patent: Jan. 13, 2026

(54) FOLDING ROCKING CHAIR FRAME AND FOLDING ROCKING CHAIR

(71) Applicant: Ninghai Jiarun Hardware Co., Ltd., Zhejiang (CN)

(72) Inventor: Zhenguo Zhang, Zhejiang (CN)

(73) Assignee: Ninghai Jiarun Hardware Co., Ltd., Ningbo (CN)

( * ) Notice: Subject to any disclaimer, the term of this patent is extended or adjusted under 35 U.S.C. 154(b) by 0 days.

(21) Appl. No.: 19/315,483

(22) Filed: Aug. 30, 2025

(30) Foreign Application Priority Data

Aug. 8, 2025 (CN) ..... 202521686765.5

(51) Int. Cl.
*A47C 3/03* (2006.01)
*A47C 3/025* (2006.01)
*A47C 4/28* (2006.01)

(52) U.S. Cl.
CPC ..... *A47C 3/03* (2013.01); *A47C 3/025* (2013.01); *A47C 4/286* (2013.01)

(58) Field of Classification Search
CPC ..... A47C 4/286; A47C 9/10; A47C 9/105; A47C 3/03; A47C 3/02; A47C 3/025
USPC ..... 297/270.1, 270.2
See application file for complete search history.

(56) References Cited

U.S. PATENT DOCUMENTS

| | | | | |
|---|---|---|---|---|
| 8,979,184 | B2 * | 3/2015 | Stafford | A47C 9/105 297/16.2 |
| 11,871,848 | B1 * | 1/2024 | Wang | A47C 4/286 |
| 11,980,292 | B1 * | 5/2024 | Wang | A47C 7/14 |
| 12,349,806 | B1 * | 7/2025 | Wang | A47C 3/025 |

* cited by examiner

*Primary Examiner* — Milton Nelson, Jr.

(57) ABSTRACT

A folding rocking chair frame and a folding rocking chair are provided. The folding rocking chair frame includes: an upper support assembly, including an upper cover, an upper base, and a plurality of upper connecting rods, one end of each of the plurality of upper connecting rods being connected to the upper cover and rotatable relative to the upper cover, the upper cover being swingable back and forth relative to the upper base between a horizontal position and a lower swing position; a lower support assembly, including a lower base and a plurality of lower connecting rods, one end of each of the plurality of lower connecting rods being connected to the lower base and rotatable relative to the lower base, the upper base being connected to the lower base; a locking device configured to connect the upper cover to the upper base in a locked state.

18 Claims, 18 Drawing Sheets

FOLDING ROCKING CHAIR FRAME AND FOLDING ROCKING CHAIR

CROSS REFERENCE TO RELATED APPLICATIONS

The present application claims the benefit of Chinese Patent Application No. 202521686765.5 filed on Aug. 8, 2025, the contents of which are incorporated herein by reference in their entirety.

TECHNICAL FIELD

The present disclosure relates to the technical field of folding chairs, and more particularly to a folding rocking chair frame and a folding rocking chair.

BACKGROUND TECHNOLOGY

Existing outdoor folding chairs are widely used for camping, fishing, picnics, and other outdoor activities due to their easy folding, storage, and portability. To enhance user's comfort, some folding chairs incorporate a rocking chair function based on the traditional structure. The upper and lower frames can deflect relative to each other, achieving a back and forth rocking effect. An elastic member is often placed between the two to provide resistance and resilience.

However, these portable rocking chairs are designed to be always in a rockable state, lacking the ability to secure the chair in a stable, stationary position. This prevents users from freely switching between a rocking chair mode and an ordinary stationary chair mode according to their needs. This single function not only limits the chair's usage scenarios, but also causes inconvenience when users need to maintain a stable sitting position or use it on uneven surfaces, thus reducing overall convenience and comfort of use.

SUMMARY

While existing outdoor folding chairs are easy to store and carry, and can achieve rocking chair functionality through relative deflection of upper and lower frames in combination with an elastic member, they are always in a rockable state and lack the ability to stabilize the chair, preventing them from freely switching between a rocking chair mode and an ordinary stationary chair mode. This not only limits the folding chair's usage scenarios, but also causes inconvenience when users need to maintain a stable sitting position or use it on uneven surfaces.

The purpose of the present disclosure is to provide a folding rocking chair frame that can freely switch between a rocking chair function and a stationary state, thereby improving the convenience and comfort of use of existing portable rocking chairs and increasing the diversity of their applicable scenarios.

The embodiments of the present disclosure further provide a folding rocking chair having the folding rocking chair frame.

The technical solution adopted by the present disclosure is: to provide a folding rocking chair frame, including:

an upper support assembly, including an upper cover, an upper base, and a plurality of upper connecting rods, one end of each of the plurality of upper connecting rods being connected to the upper cover and rotatable relative to the upper cover, the upper cover being swingable back and forth relative to the upper base between a horizontal position and a lower swing position;

a lower support assembly, including a lower base and a plurality of lower connecting rods, one end of each of the plurality of lower connecting rods being connected to the lower base and rotatable relative to the lower base, the upper base being connected to the lower base;

a locking device configured to connect the upper cover to the upper base in a locked state, so as to maintain the upper cover in the horizontal position and restrict back and forth swinging, and to allow the upper cover to swing back and forth relative to the upper base in an unlocked state.

After adopting the above technical solution, the present disclosure has the following beneficial effects:

1. Free Mode Switching to Adapt to Multiple Scenarios

A locking device, located between the upper cover and the upper base, controls the upper cover's swinging motion. When locked, the upper cover is held horizontally, restricting its back and forth swinging, creating a stable, stationary chair. When unlocked, the upper cover can freely swing back and forth relative to the upper base, achieving a rocking chair function.

This design enables the folding chair to switch freely between a rocking chair mode and a stationary chair mode, effectively solving the problem that existing portable rocking chairs are always in a rocking state and have a single usage scenario, allowing the product to be flexibly used in various outdoor scenarios such as camping, picnics, and fishing.

2. High Stability in Stationary Mode, Improving Safety and Comfort

When locked, the chair's entire structure is stabilized, preventing unnecessary movement when the user needs to maintain a stationary sitting position. Furthermore, on uneven surfaces or steep slopes, the locked position significantly improves the chair's frame stability and load-bearing safety. This advantage provides greater comfort and safety during extended use, making it ideal for elderly people, children, or situations requiring focused activity.

3. Maintain Entertainment and Leisure Attributes in Rocking Chair Mode

When unlocked, the top cover swings back and forth, supported by the upper base, creating a portable rocking chair for leisure. While camping, relaxing, or exploring the outdoors, users can enjoy the comfort and relaxation of rocking, while retaining the lightweight and quick-to-fold features of a folding chair.

4. Simple Structure, High Reliability, Easy to Operate and Carry

The overall structure of the present disclosure consists of an upper support assembly, a lower support assembly, and a locking mechanism. The rotatable design of the upper and lower connecting rods allows for convenient folding and unfolding. The locking mechanism allows for simple mode switching, allowing users to quickly change between stationary and rocking positions. The entire chair is compact and lightweight, making it easy to carry and use outdoors.

According to one embodiment of the present disclosure, the upper cover is provided with a first keyhole, and the upper base is provided with a second keyhole at a position corresponding to the first keyhole. When the upper cover is in a horizontal position, the first keyhole is aligned with the second keyhole, and the locking device is inserted into a through-hole formed by the first keyhole and the second keyhole to complete locking. This design is simple in structure, allowing users to quickly and reliably lock or unlock the upper cover when it is in a horizontal position, thereby improving operational convenience.

According to one embodiment of the present disclosure, the first keyhole is provided in a top wall or an outer circumferential surface of the upper cover. A second keyhole is correspondingly set in a top wall or side wall of the upper base, and the second keyhole is staggered with a second shaft opening.

According to one embodiment of the present disclosure, a torsion spring and/or a helical spring are provided between the upper cover and the upper base, the torsion spring and/or the helical spring having an elastic force that urges the upper cover to spring back to a horizontal state, so as to quickly restore to a stationary mode after the rocking chair state is released, thereby improving operating comfort.

According to one embodiment of the present disclosure, the locking device includes a locking member and an anti-lost rope. The locking member is insertable into the through-hole. The anti-lost rope is configured to secure the locking member to the upper support assembly or the lower support assembly. By providing the anti-lost rope, the locking member remains on the upper support assembly or the lower support assembly during use and is not easily lost, thereby improving the structural reliability.

According to one embodiment of the present disclosure, a stop portion having a height difference is provided at an upper end of the upper base. When the upper cover is in the horizontal position, a gap H is formed between a top wall of the upper cover and a lowest point of the stop portion, thereby reserving a space for the upper cover to swing back and forth. This design ensures that the upper cover has ample space to swing back and forth when unlocked.

According to one embodiment of the present disclosure, the upper base and the lower base are connected by a vertically disposed connecting bolt, and the upper base is rotatable relative to the lower base around the connecting bolt. That is, the upper support assembly can rotate relative to the lower support assembly around a vertical axis, so that the folding rocking chair has a self-rotating function.

According to one embodiment of the present disclosure, a shouldered bushing is provided at a top portion of the lower base, the shouldered bushing being fixed circumferentially relative to the lower base, and in contact with a bottom portion of the upper base, so as to allow the upper base to rotate around the connecting bolt. This shouldered bushing design improves the support stability and wear resistance of the rotating components, thereby extending the product's service life.

According to one embodiment of the present disclosure, a plurality of limiting members are elastically mounted on a respective one of ends of the plurality of lower connecting rods proximal to the lower base, each of the plurality of limiting members being reciprocally movable along a longitudinal direction of a respective one of the plurality of lower connecting rods, the lower base being provided with a plurality of positioning portions. When the plurality of lower connecting rods are in a folded state relative to the lower base, each of the plurality of limiting members is inserted into a respective one of the plurality of positioning portions, thereby providing resistance to rotation of the plurality of lower connecting rods relative to the lower base. This design effectively limits the lower connecting rod's wobbling when folded, ensuring stability and safety during storage and transportation.

According to one embodiment of the present disclosure, a plurality of retaining springs are provided inside a respective one of the plurality of lower connecting rods and are movable unidirectionally along longitudinal directions of the plurality of lower connecting rods, a plurality of return springs being provided between respective ones of the plurality of retaining springs and the plurality of limiting members, one end of each of the plurality of return springs being abutted against a respective one of the plurality of retaining springs, and another end being abutted against a respective one of the plurality of limiting members; or a plurality of connecting arms are nested within a respective one of the plurality of lower connecting rods, each of the plurality of limiting members being slidable along a respective one of the plurality of connecting arms in its longitudinal direction, a plurality of unidirectionally movable retaining springs being provided inside a respective one of the plurality of connecting arms, a plurality of return springs being provided between respective ones of the plurality of retaining springs and the plurality of limiting members, one end of each of the plurality of return springs being abutted against a respective one of the plurality of retaining springs, and another end being abutted against a respective one of the plurality of limiting members.

According to one embodiment of the present disclosure, the folding rocking chair further includes a chair fabric mounted on the folding rocking chair frame. The chair fabric and the folding rocking chair frame are combined to form a complete folding rocking chair that meets the needs of outdoor use and combines comfort and portability.

BRIEF DESCRIPTION OF THE DRAWINGS

In order to more clearly illustrate the embodiments of the present disclosure or the technical solutions in the prior art, the following briefly introduces the drawings required for use in the embodiments or the description of the prior art. Obviously, the drawings described below are only some embodiments of the present disclosure. For a person ordinarily skilled in the art, other drawings can be obtained based on these drawings without contributing any creative effort.

DESCRIPTION OF THE NUMBERS IN THE FIGURES

Figure 1:
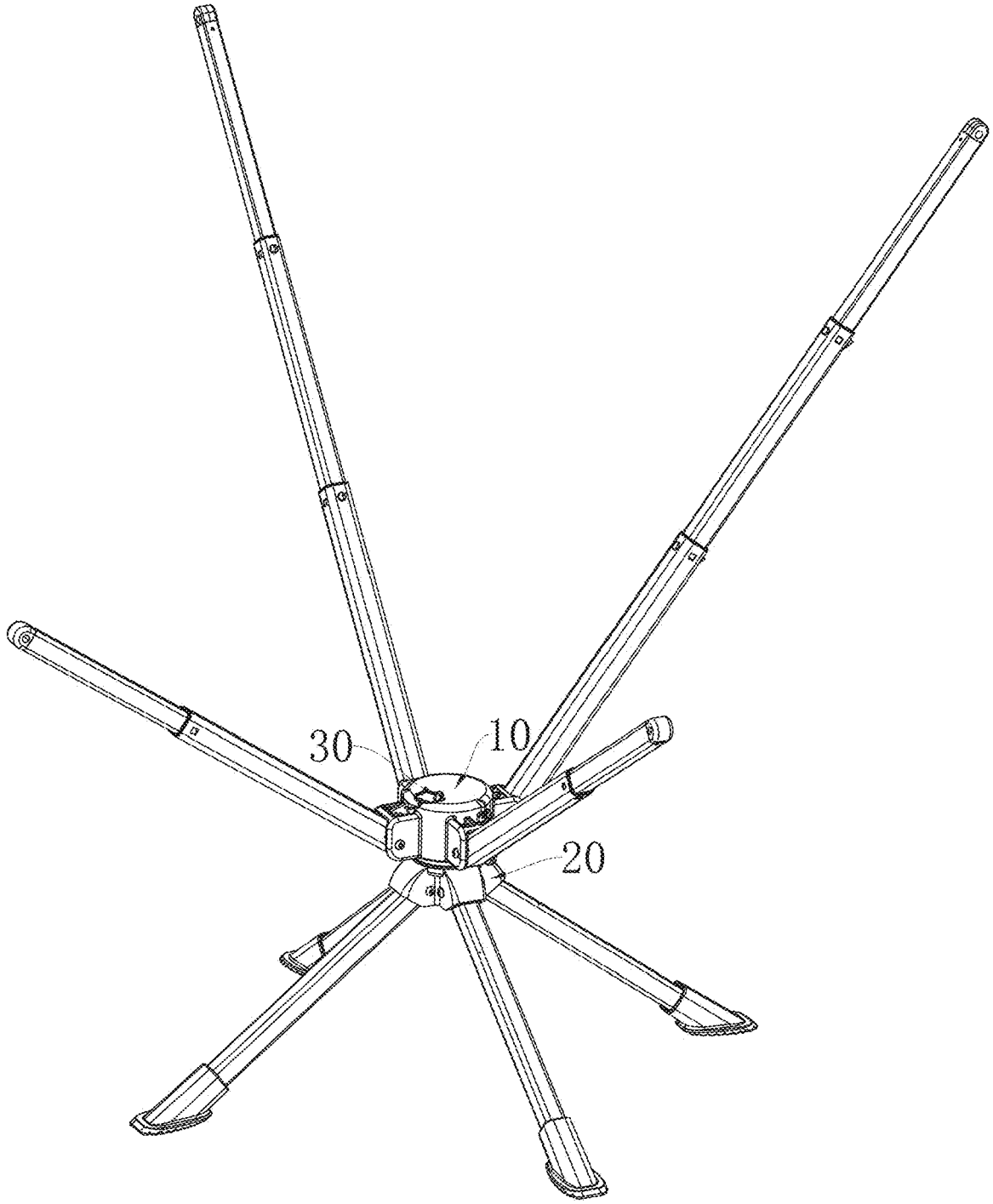
FIG. 1 is a perspective view of the folding rocking chair frame in an embodiment of the present disclosure.

10, upper support assembly; 20, lower support assembly; 30, locking device;

11, upper cover; 12, upper connecting rod; 13, upper base; 14, torsion spring; 15, first rotating shaft; 16, helical spring;

11*a*, top wall; 11*b*, upper opening groove; 11*c*, first keyhole; 11*d*, first shaft opening;

131, base body; 132, support column; 133, limiting flange; 134, central axis column;

131*a*, raised platform;

132*a*, second shaft opening; 132*b*, second keyhole; 132*c*, stop portion; 132*d*, mounting groove;

21, lower base; 22, lower connecting rod; 23, shouldered bushing; 24, connecting bolt; 25, connecting arm; 26, limiting member; 27, return spring; 28, second rotating shaft; 29, retaining spring;

21*a*, central hole; 21*b*, matching groove; 21*c*, positioning column; 21*d*, positioning portion;

23*a*, outer step; 23*b*, recessed groove; 23*c*, positioning hole; 23*d*, bushing portion;

26*a*, strip-shaped hole; 26*b*, top end; 26*c*, inclined surface;

31, locking member; 32, anti-lost rope.

DETAILED DESCRIPTION OF THE EMBODIMENTS

The following describes the embodiments of the present disclosure in detail. Examples of the embodiments are shown in the accompanying drawings, wherein the same or similar reference numerals throughout represent the same or similar elements, or elements having the same or similar functions. The embodiments described below with reference to the accompanying drawings are exemplary and are intended only to explain the present disclosure and are not to be construed as limiting the present disclosure.

Embodiment 1

As shown in FIGS. 1-14, this embodiment discloses a folding rocking chair frame, including an upper support assembly 10, a lower support assembly 20, and a locking device 30.

Figure 2:
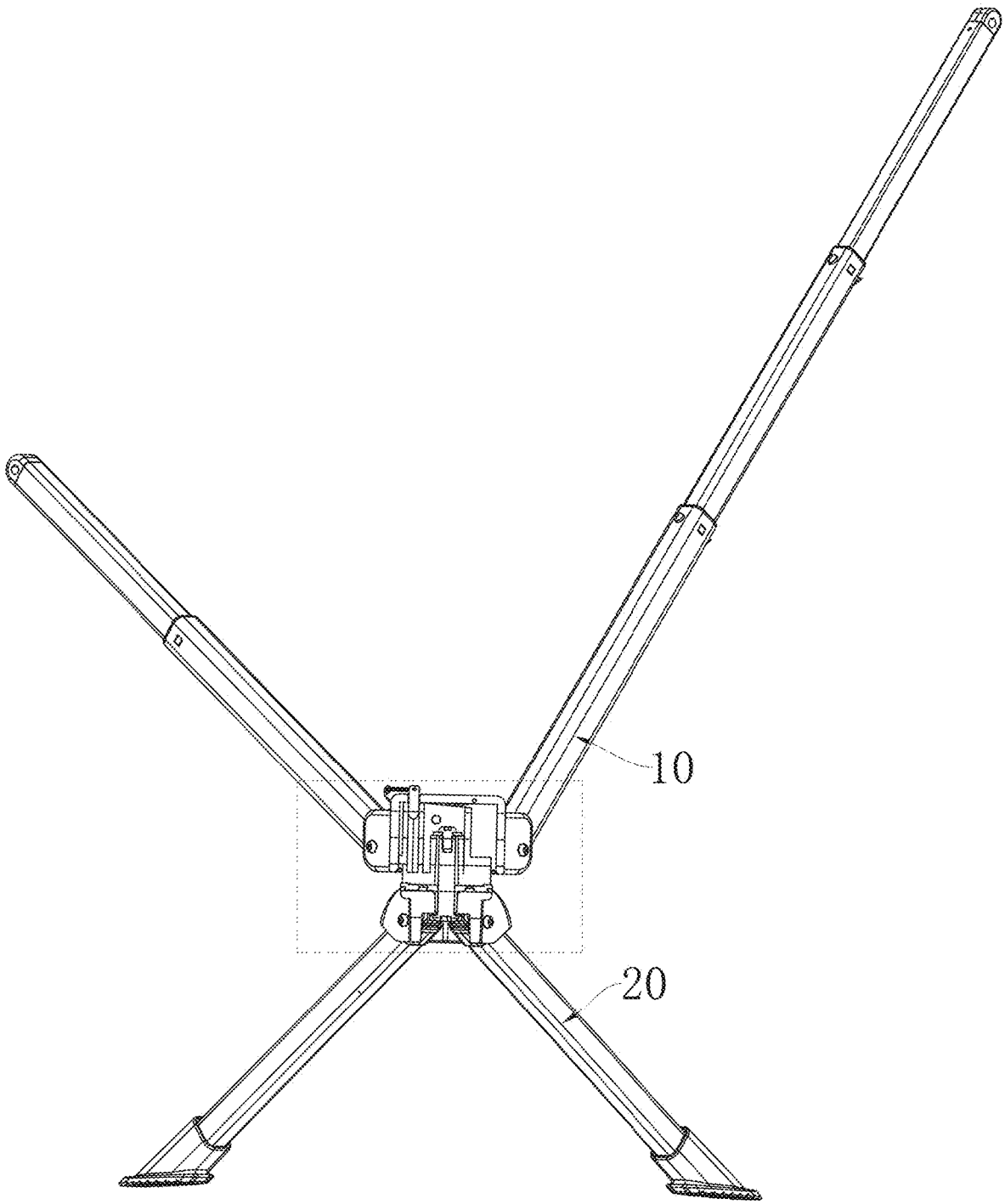
FIG. 2 is a half-sectional view of the folding rocking chair frame in an embodiment of the present disclosure.
Figure 3:
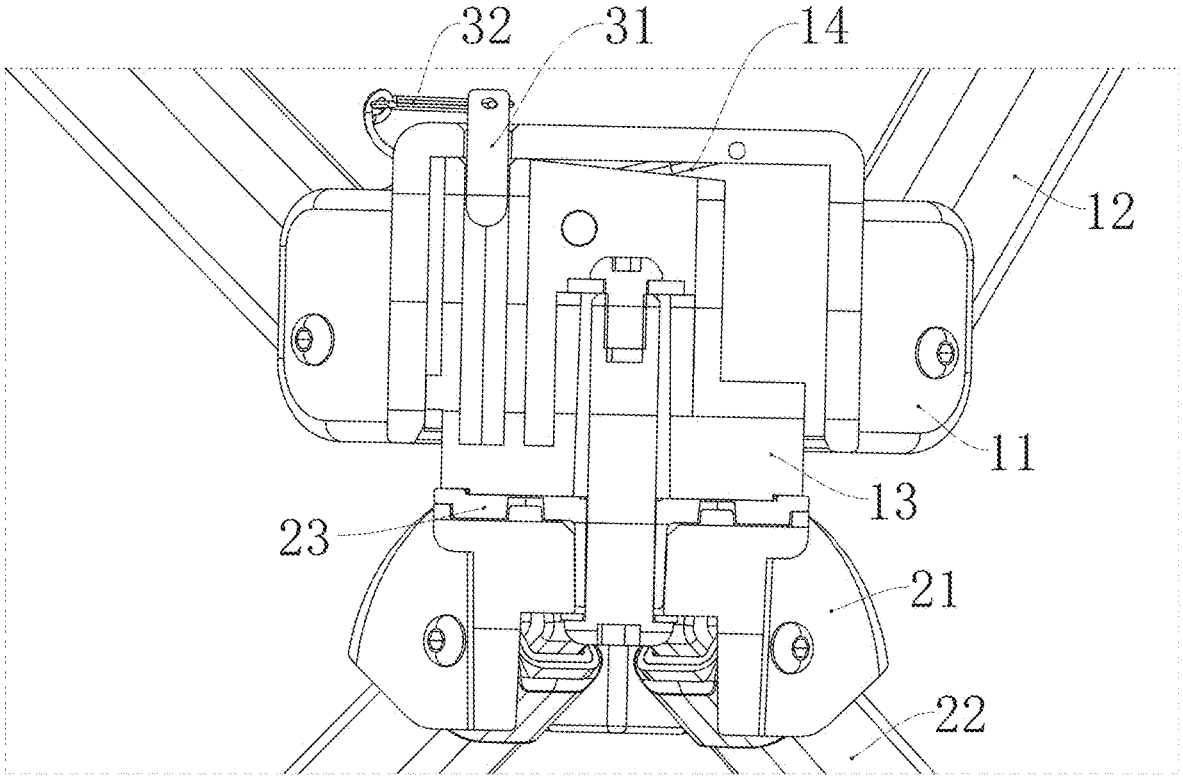
FIG. 3 is a partial enlarged view of FIG. 2.
Figure 4:
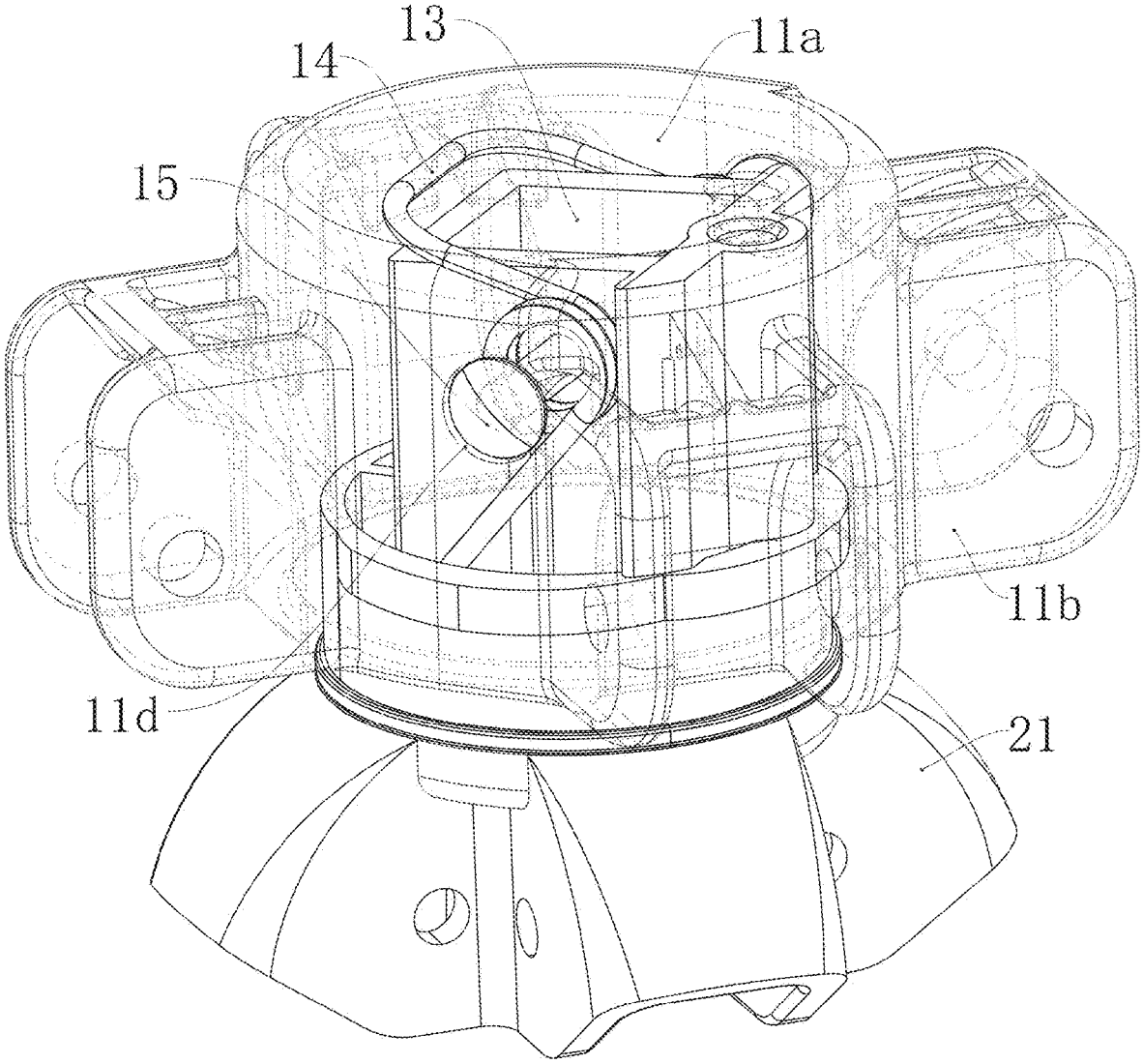
FIG. 4 is a schematic diagram of a partial structure of the folding rocking chair frame in an embodiment of the present disclosure.

As shown in FIGS. 2-4, the upper support assembly 10 includes an upper cover 11, an upper base 13, and a plurality of upper connecting rods 12. One end of each of the plurality of upper connecting rods 12 is connected to the upper cover 11, and is rotatable relative to the upper cover 11, thereby allowing the upper cover 11 to change its angle during use. The upper cover 11 is swingable back and forth relative to the upper base 13 between a horizontal position and a lower swing position, so as to provide a rocking chair function.

Figure 12:
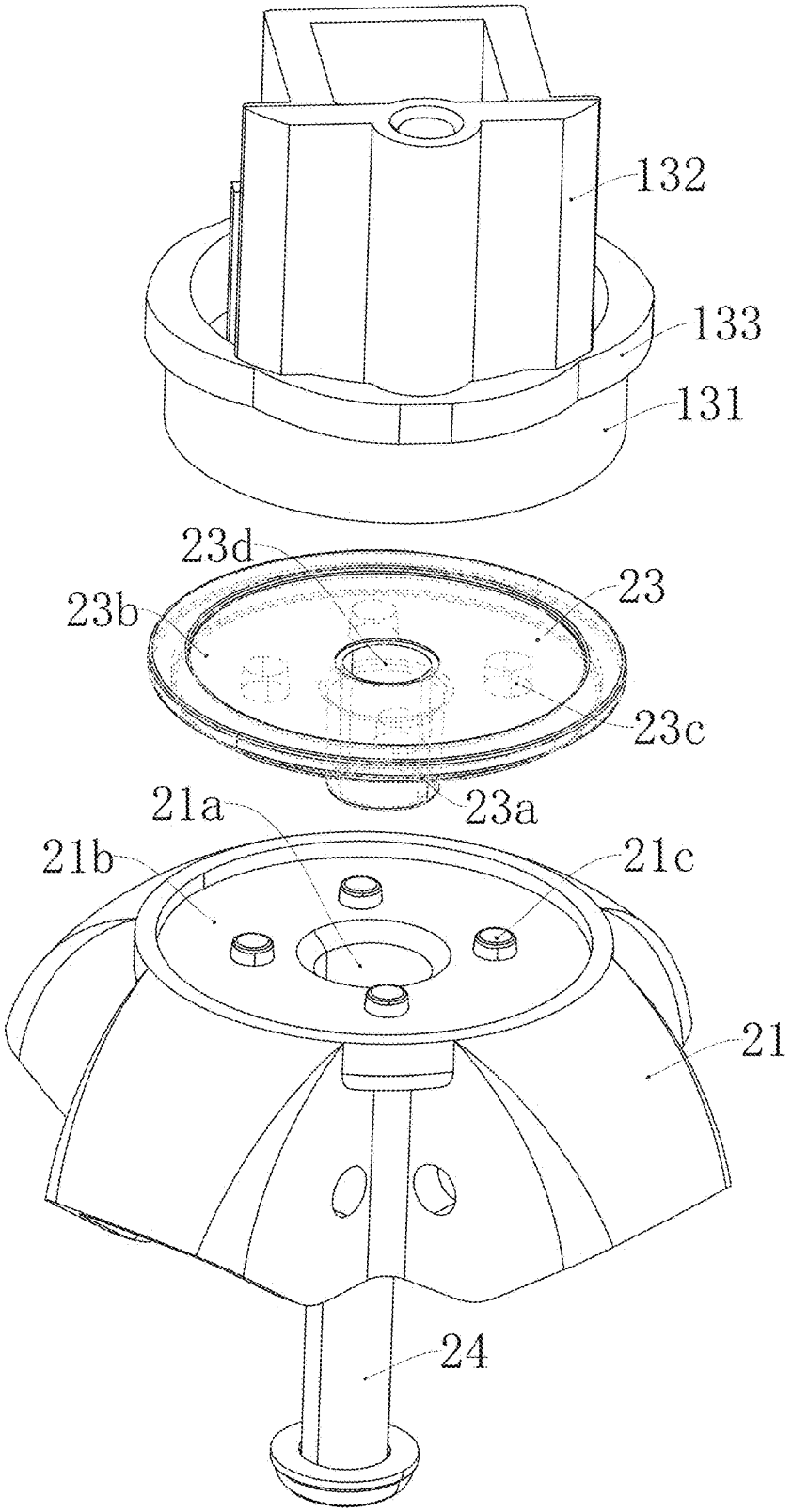
FIG. 12 is an exploded view of the upper base, the shouldered bushing, and the lower base in an embodiment of the present disclosure.
Figure 13:
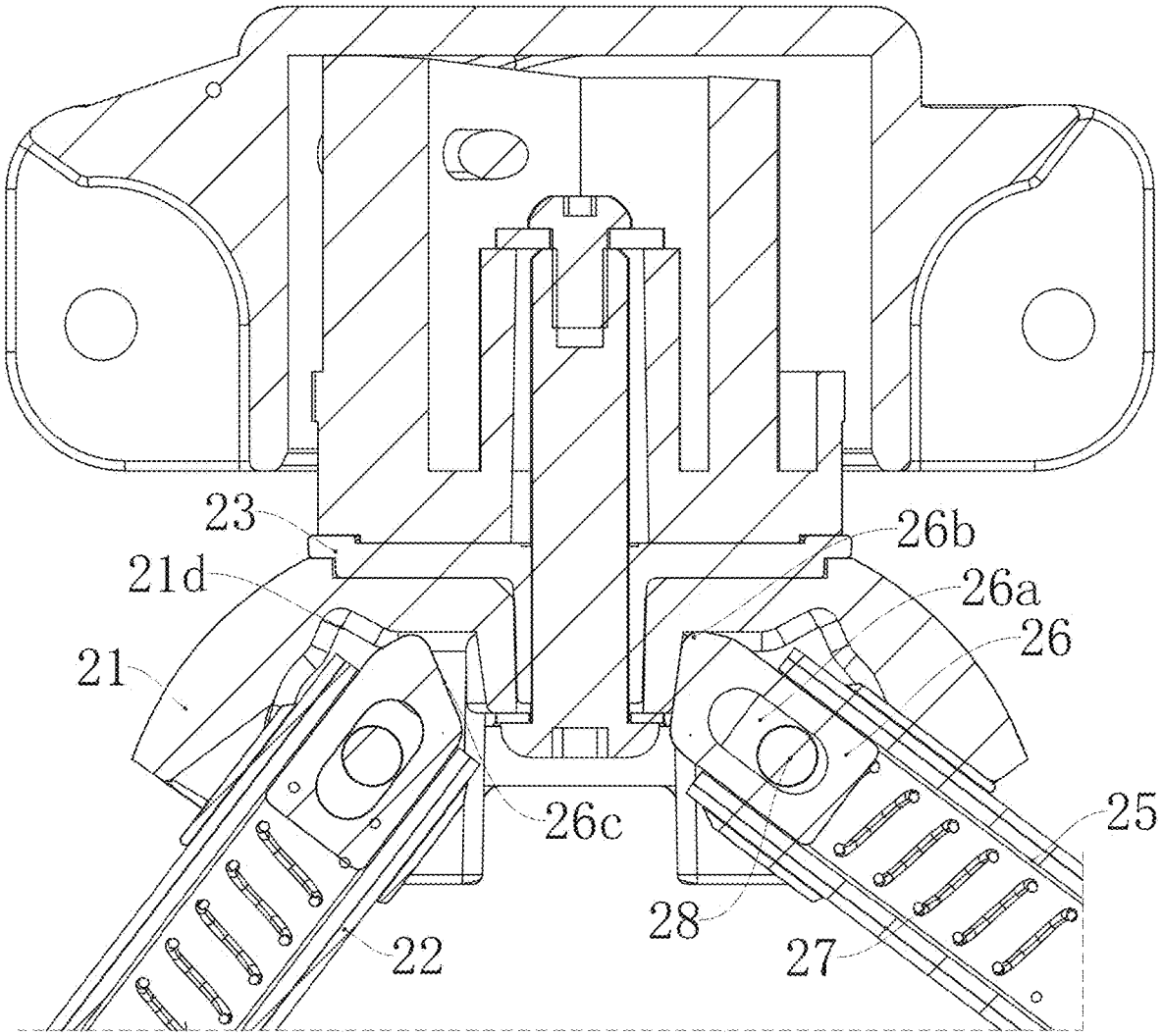
FIG. 13 is a cross-sectional view of the rocking chair frame when the lower connecting rods are folded in an embodiment of the present disclosure.
Figure 14:
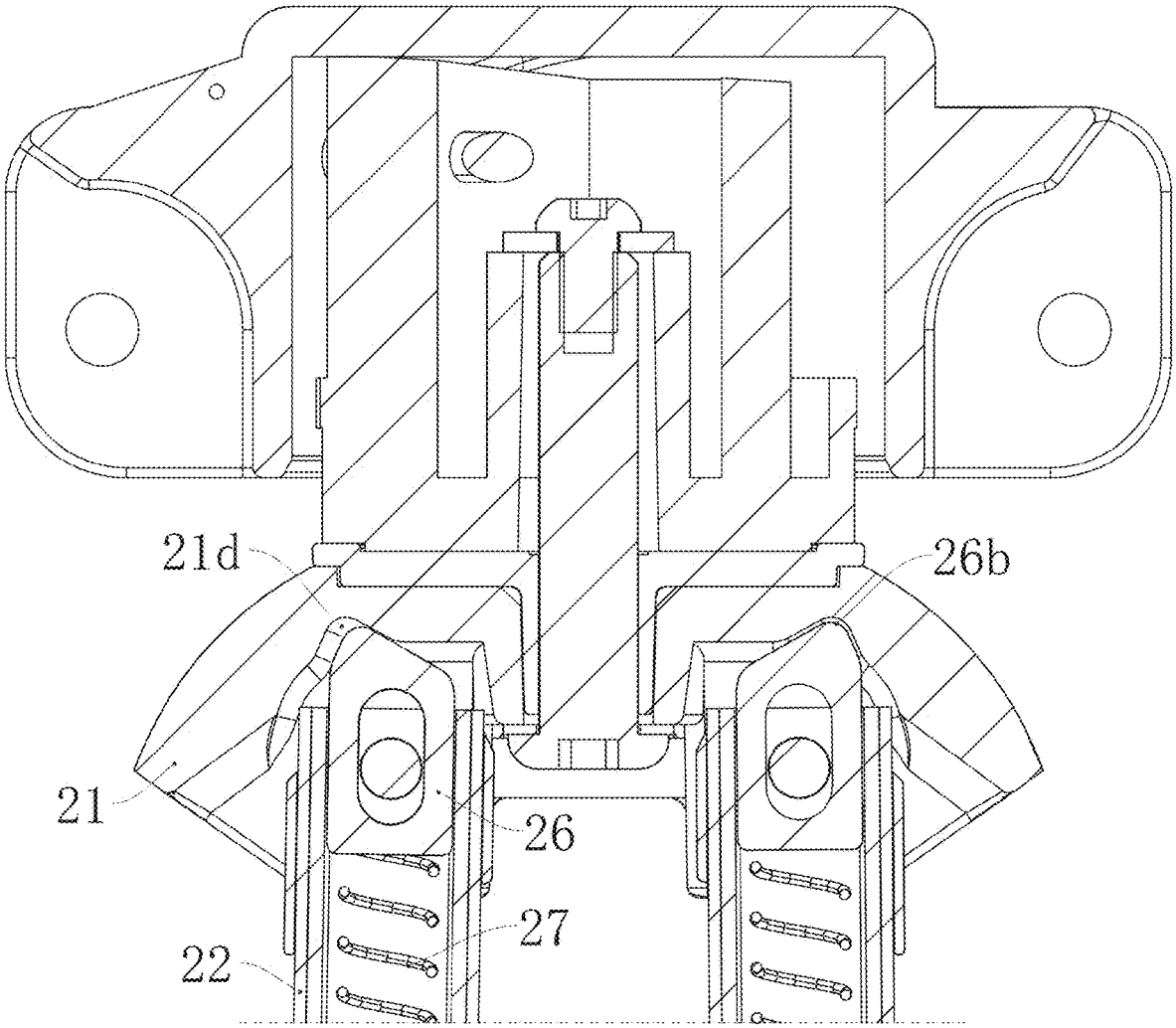
FIG. 14 is a cross-sectional view of the rocking chair frame after the lower connecting rods are folded in an embodiment of the present disclosure.

As shown in FIGS. 12-14, the lower support assembly 20 includes a lower base 21 and a plurality of lower connecting rods 22. One end of each of the plurality of lower connecting rods 22 is connected to the lower base 21 and is rotatable relative to the lower base 21, allowing the lower support assembly 20 to be folded or unfolded. The upper base 13 is fixedly connected to the lower base 21 through a connecting structure, thereby ensuring that the upper support assembly 10 is stably mounted on the lower support assembly 20.

The locking device 30 is used to connect the upper cover 11 to the upper base 13 in a locked state, so as to maintain the upper cover 11 in the horizontal position and restrict back and forth swinging, and to allow the upper cover 11 to swing back and forth freely relative to the upper base 13 in an unlocked state, realizing the switch from a stationary mode to a rocking chair mode.

Furthermore, as shown in combination with FIG. 4, the upper cover 11 is connected with at least three upper connecting rods 12, which may be telescopic rods or non-telescopic rods. In this embodiment, both the upper connecting rods 12 and the lower connecting rods 22 adopt a telescopic rod structure, so as to reduce the size when folded and stored. The four lower connecting rods 22 are of equal length. In the four upper connecting rods 12, the two at the front are shorter than the two at the back. The two upper connecting rods 12 at the back are used as supporting rods at the back of the chair. The upper ends of the four upper connecting rods 12 are used to connect to the four corners of a chair fabric. Correspondingly, four upper opening grooves 11*b* are provided on the outer periphery of the upper cover 11, and the four upper opening grooves 11*b* are arranged in a cross shape.

The upper cover 11 and the lower base 21 are connected by a horizontally arranged first rotating shaft 15. Two coaxial first shaft openings 11*d* are provided on the outer circumference of the upper cover 11, and second shaft openings 132*a* are provided at corresponding positions on the upper base 13. The first rotating shaft 15 passes through the first and second shaft openings 11*d*, 132*a* in sequence, so as to achieve a back and forth swinging connection between the upper cover 11 and the lower base 21.

Figure 5:
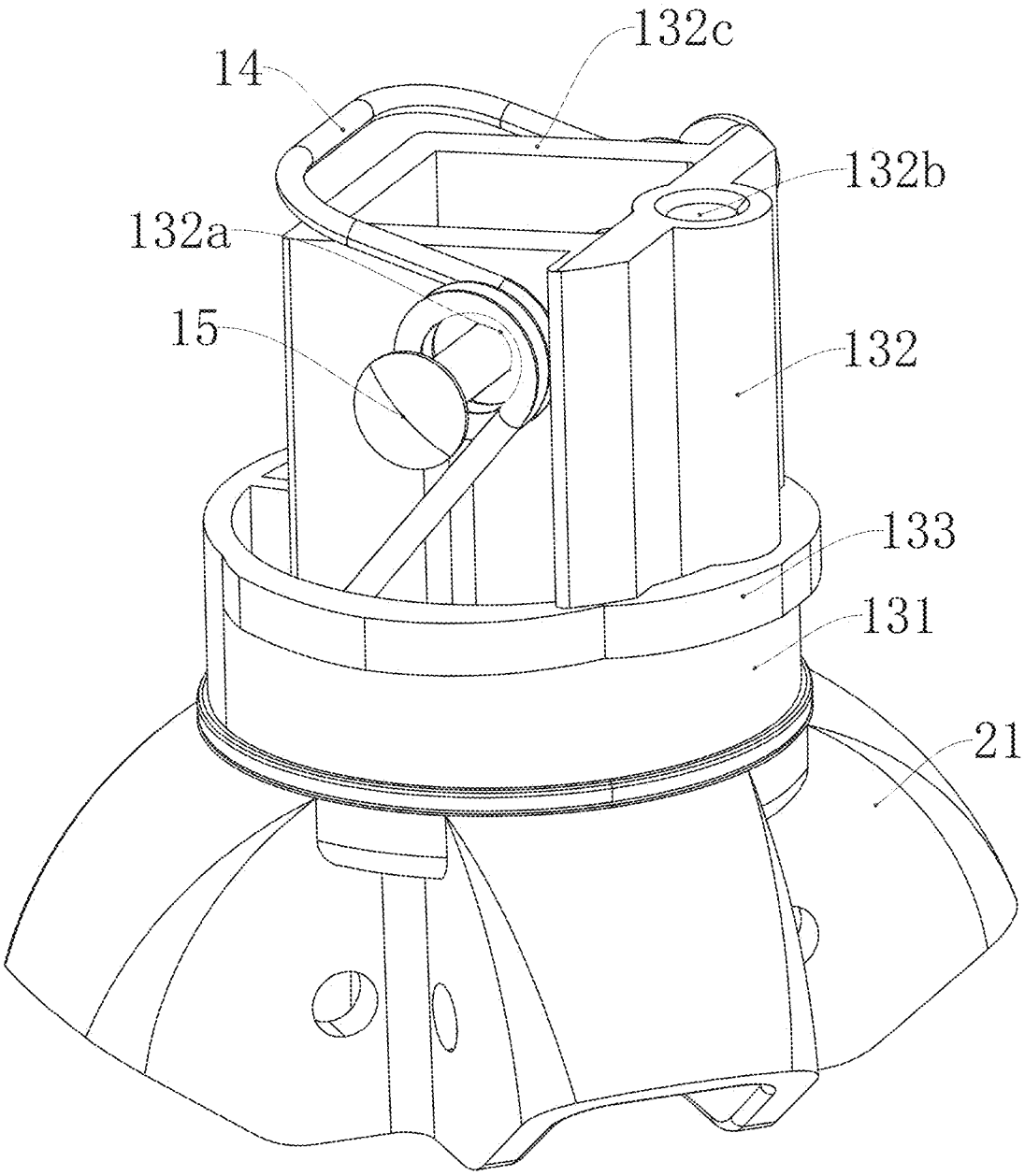
FIG. 5 is a perspective view of the upper support assembly after removing the upper cover in an embodiment of the present disclosure.

Furthermore, as shown in conjunction with FIG. 5, the upper base 13 includes a cylindrical base body 131, a support column 132 formed by extending upward from an upper end of the base body 131, and a limiting flange 133 arranged between the base body 131 and the support column 132. The support column 132 is provided with a second keyhole 132*b* in a vertical direction, and the opening of the second keyhole 132*b* is facing upward. An upper end surface of the support column 132 forms a stop portion 132*c* having a height difference. The upper cover 11 has a top wall 11*a* and a side wall around the edge of the top wall 11*a*, forming a cavity with an opening facing downward. The limiting flange 133 and the side wall of the upper cover 11 are mutually limited, thereby limiting horizontal deviation of the upper cover 11 and reducing the force on the first rotating shaft 15.

Figure 6:
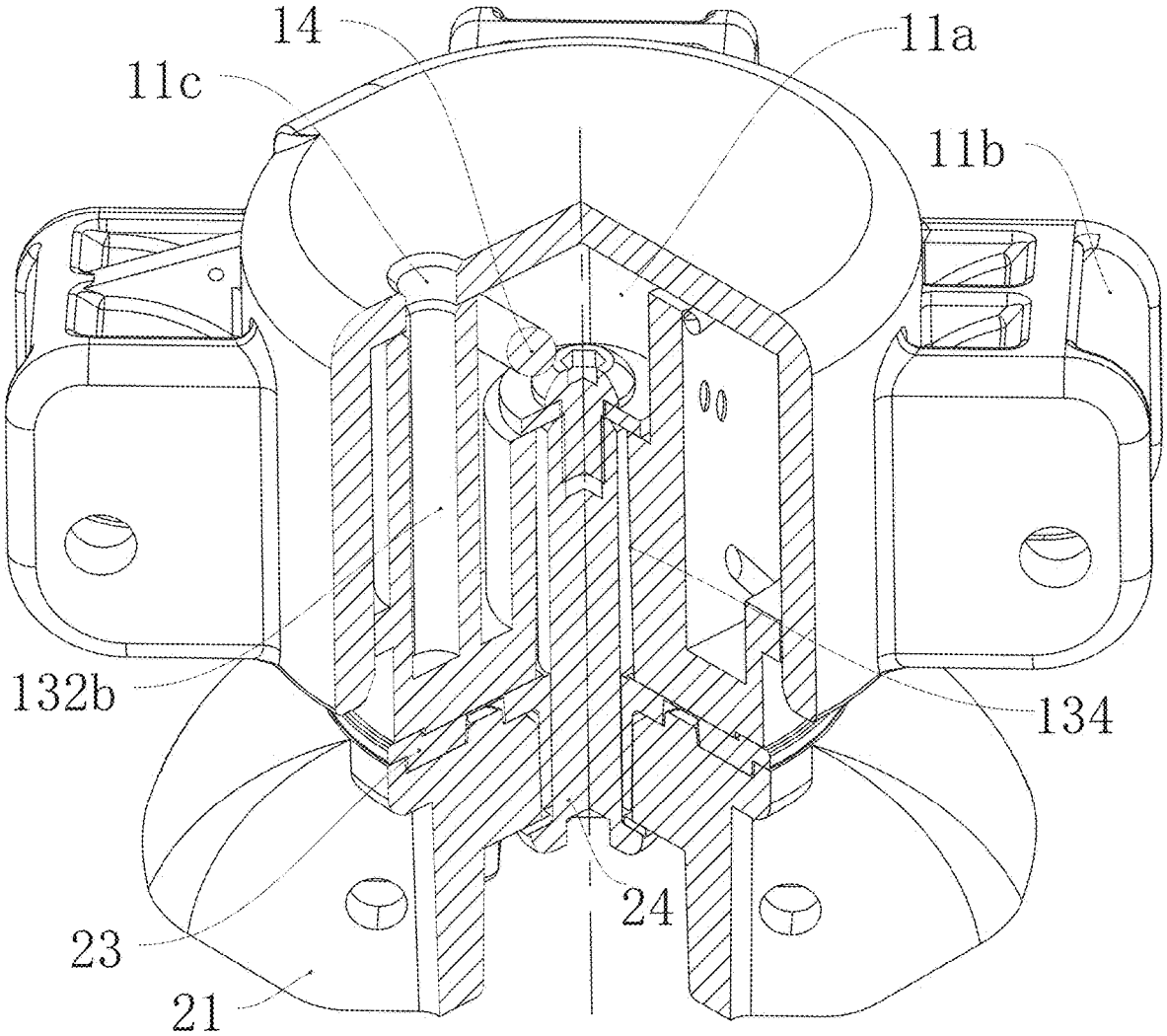
FIG. 6 is a half-sectional perspective view of the folding rocking chair frame in an embodiment of the present disclosure.

As shown in conjunction with FIG. 6, a central axis column 134 is vertically disposed within the support column 132. The central axis column 134 is arranged along a central axis of upper base 13 and defines therein a vertical hole. The lower base 21 is provided with a central hole 21*a*. The vertical hole in central axis column 134 is aligned with the central hole 21*a*, thereby ensuring coaxial mounting of the two and enhancing load-bearing stability.

Figure 7:
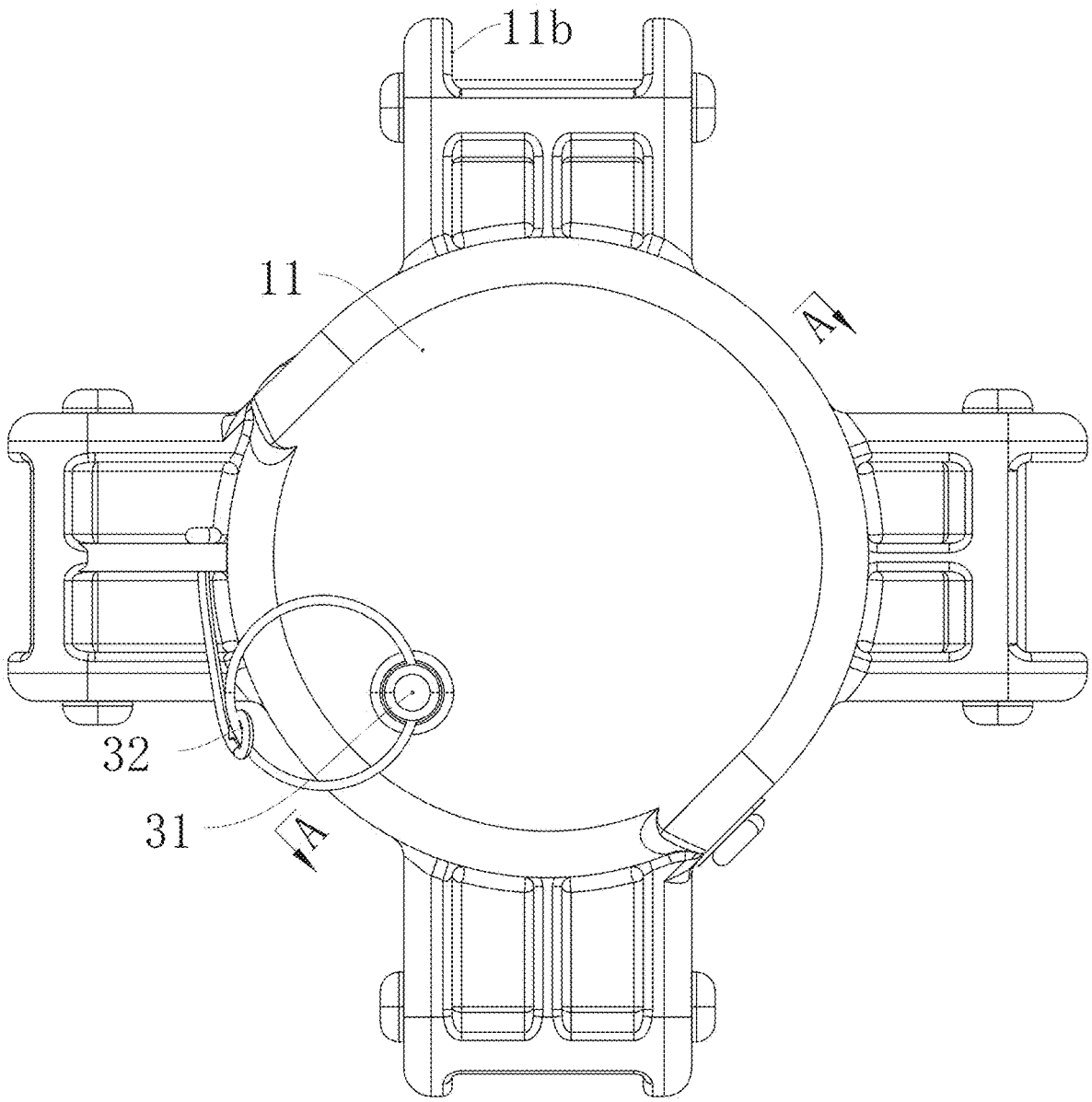
FIG. 7 is a top view of the folding rocking chair frame in an embodiment of the present disclosure.
Figure 8:
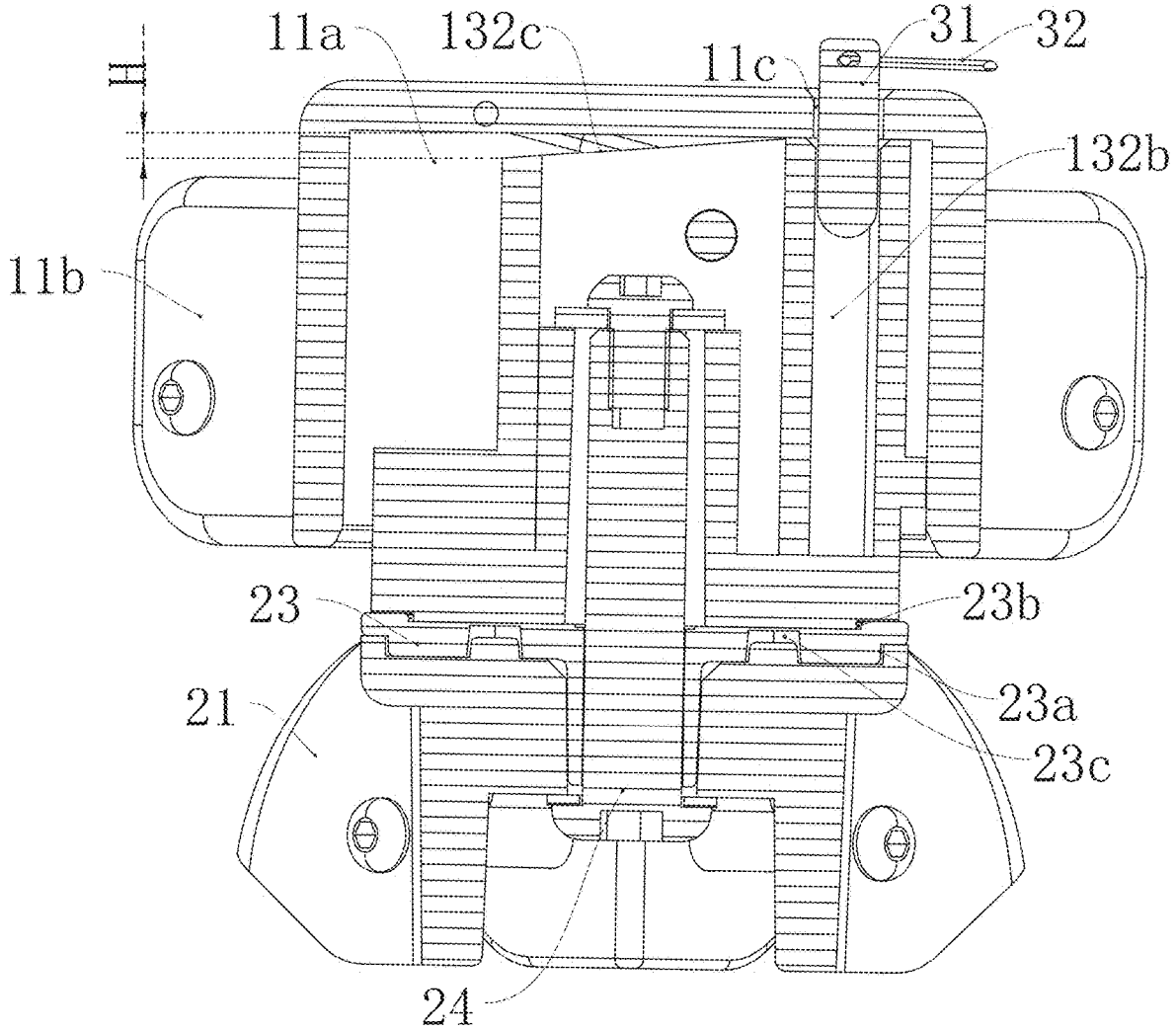
FIG. 8 is a cross-sectional view taken along line A-A in FIG. 7.
Figure 9:
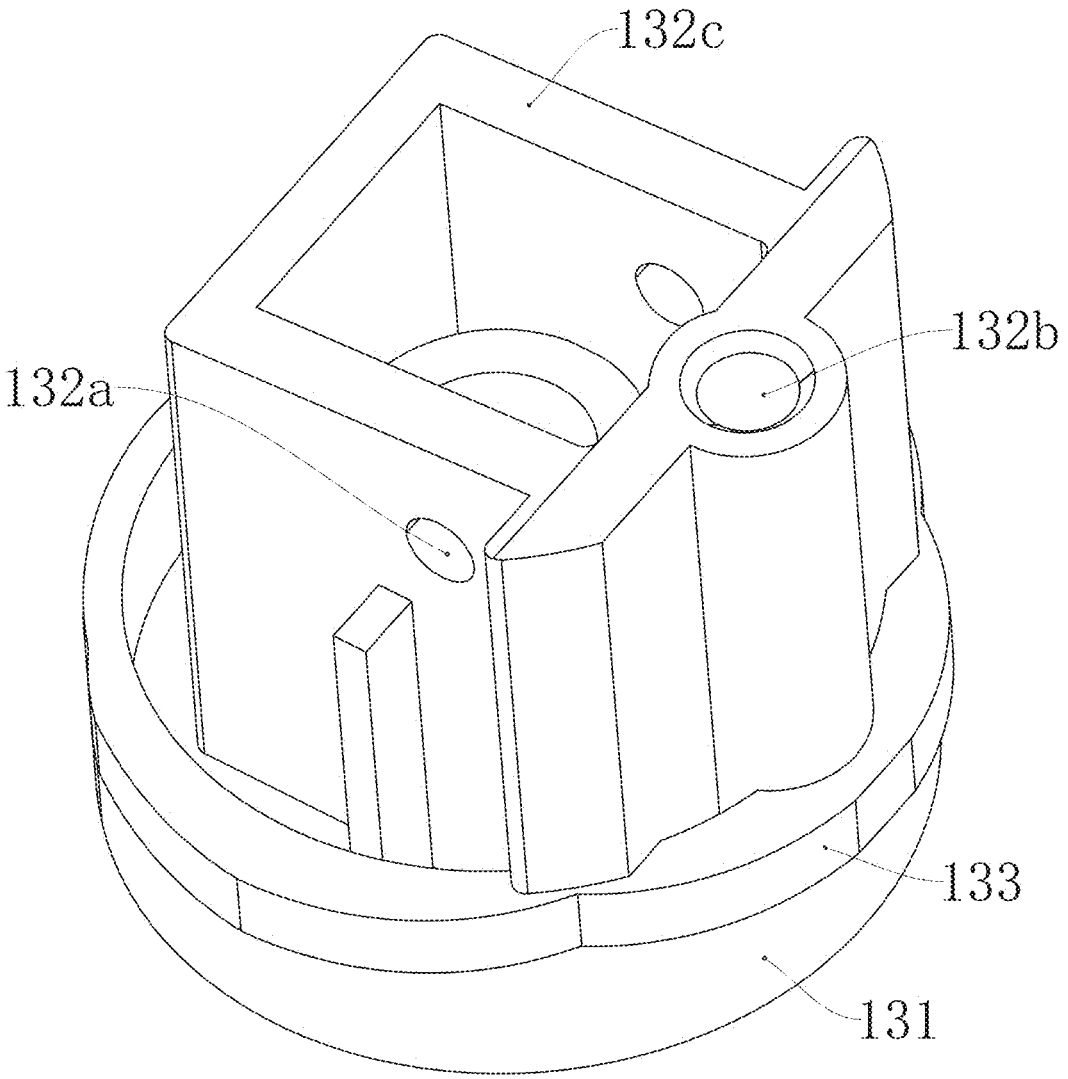
FIG. 9 is a perspective view of the upper base in an embodiment of the present disclosure.
Figure 10:
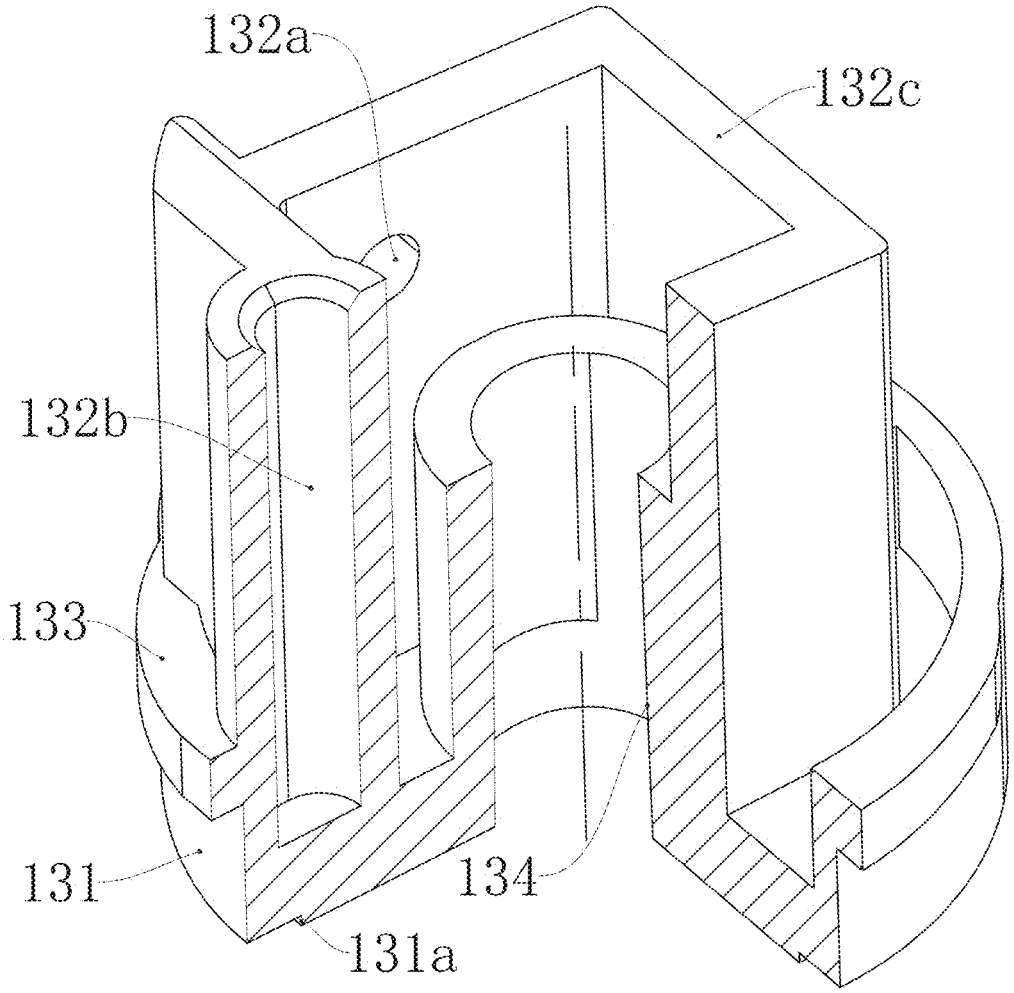
FIG. 10 is a half-sectional perspective view of the upper base in an embodiment of the present disclosure.
Figure 11:
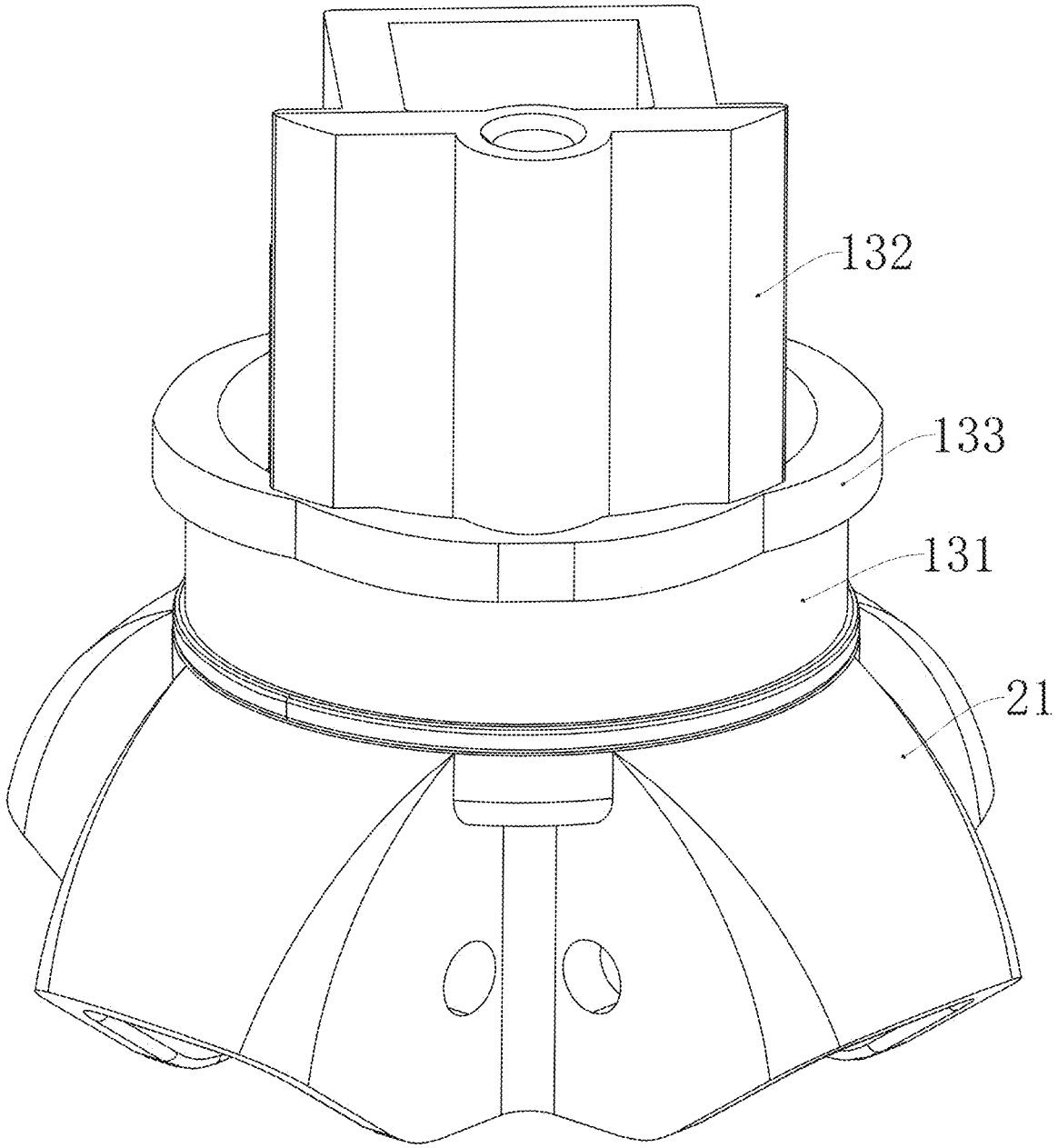
FIG. 11 is a schematic structural diagram of the upper base and the lower base in an embodiment of the present disclosure.

Specifically, as shown in conjunction with FIGS. 7-8, the top wall 11*a* of the upper cover 11 is provided with a first keyhole 11*c*, and the upper base 13 is provided with a second keyhole 132*b* at a position corresponding to the first keyhole 11*c*. When the upper cover 11 is in a horizontal position, the first keyhole 11*c* is aligned with the second keyhole 132*b*, and the locking device 30 is inserted into a through-hole formed by the combination of the first keyhole 11*c* and the second keyhole 132*b* to complete locking. The locking device 30 includes a locking member 31 and an anti-lost rope 32. The locking member 31 is a pin. One end of the anti-lost rope 32 is connected to the upper cover 11, and the other end is connected to the pin, so that the pin can be retained on the upper support assembly 10. When the pin is inserted into the through-hole, relative rotation between the upper cover 11 and the upper base 13 can be limited, and stable locking is achieved.

In another embodiment, the first keyhole 11*c* may be provided in an outer circumferential surface of the upper cover 11, and the corresponding second keyhole 132*b* may be provided on one side of the support column 132, so that the user can perform inserting and pulling out operations from the side.

Specifically, as shown in combination with FIG. 4, a torsion spring 14 is disposed between the upper cover 11 and the upper base 13. The torsion spring 14 has an elastic force that urges the upper cover 11 to spring back to the horizontal position. The torsion spring 14 is mounted on the first rotating shaft 15. The elastic end at the upper end of the torsion spring 14 is in contact with the top wall 11*a* of the upper cover 11. When the upper cover 11 swings downward, the torsion spring 14 deforms and stores energy. When the external force is removed, the torsion spring 14 springs back, thereby returning the upper cover 11 to the horizontal position.

Specifically, as shown in conjunction with FIG. 8, the stop portion 132*c* with height difference at the upper end of the upper base 13 forms a gap H with the top wall 11*a* when the upper cover 11 is in a horizontal state, thereby reserving a space for the upper cover 11 to swing back and forth, and ensuring freedom of swinging back and forth while avoiding structural interference. The upper base 13 is connected to the lower base 21 via a vertical connecting bolt 24. The upper base 13 can rotate relative to the lower base 21 around the connecting bolt 24 to realize a self-rotation function of the folding rocking chair and facilitate adjustment of the angle of use. A shouldered bushing 23 is provided at a top portion of the lower base 21. The shouldered bushing 23 is fixed circumferentially to the lower base 21, and is in contact with a bottom portion of the upper base 13 to allow the upper base 13 to rotate around the connecting bolt 24.

Furthermore, as shown in conjunction with FIG. 12, the shouldered bushing 23 may be made of a wear-resistant plastic material, and the upper base 13 and the lower base 21 may be made of aluminum alloy or engineering plastic to meet the load-bearing strength requirements. The shouldered bushing 23 is embedded between the base body 131 of the upper base 13 and the lower base 21, and a bushing portion 23*d* of the shouldered bushing 23 is matched with the central hole 21*a* of the lower base 21. The upper end of the lower base 21 is recessed to form a matching groove 21*b*, and a plurality of positioning columns 21*c* are provided in the matching groove 21*b*. An outer shoulder of the shouldered bushing 23 is provided with an outer step 23*a*, and a step surface of the outer step 23*a* abuts against a lower edge of the upper base 13, wherein a small-diameter circle matches the matching groove 21*b*, and a large-diameter circle matches an outer edge of the upper base 13. The shouldered bushing 23 is provided with a recessed groove 23*b* at its upper end and a plurality of positioning holes 23*c* at its lower end. When the shouldered bushing 23 fits into the matching groove 21*b*, the positioning columns 21*c* fit into the positioning holes 23*c* to restrict the bushing from rotating relative to the lower base 21. The lower end of the upper base 13 has a raised platform 131*a* that fits into the recessed groove 23*b* and rotates therein, ensuring smooth rotation and reducing wear.

Specifically, as shown in combination with FIG. 13, a plurality of limiting members 26 are elastically mounted on a respective one of the ends of the plurality of lower connecting rods 22 proximal to the lower base 21. Each of the plurality of limiting members 26 is reciprocally movable along a longitudinal direction of a respective one of the plurality of lower connecting rods 22. The lower base 21 is provided thereon with a plurality of positioning portions 21*d*. When the plurality of lower connecting rods 22 are in a folded state, each of the plurality of limiting members 26 is inserted into a respective one of the plurality of positioning portions 21*d*, thereby providing resistance to the rotation of the plurality of lower connecting rods 22 relative to the lower base 21, and ensuring a stable folded state.

Furthermore, as shown in conjunction with FIG. 14, a plurality of connecting arms 25 are nested within a respective one of the upper ends of the plurality of lower connecting rods 22. The plurality of connecting arms 25 have a hollow sleeve design, with a cross-section that matches the inner bores of the plurality of lower connecting rods 22 and are made of engineering plastic. The plurality of connecting arms 25 are shorter than the plurality of lower connecting rods 22. A plurality of lateral strip-shaped holes 26*a* are provided in a respective one of the plurality of limiting members 26. A plurality of second rotating shafts 28 extend through a respective one of the plurality of lower connecting rods 22, the plurality of connecting arms 25, and the plurality of lateral strip-shaped holes 26*a*. A plurality of return springs 27 are provided within a respective one of the plurality of connecting arms 25. One end of each of the plurality of return springs is abutted against a respective one of the plurality of limiting members 26, and another end is abutted against a respective one of the plurality of the retaining springs 29 in the plurality of lower connecting rods 22, thereby providing reciprocating elasticity along the plurality of lower connecting rods 22. The plurality of limiting members 26 are partially embedded in a respective one of the plurality of connecting arms 25. The other portion of each of the limiting members 26 has a top end 26*b* and an inclined surface 26*c*. When each of the lower connecting rods 22 is unfolded, the inclined surface 26*c* abuts against a sidewall of the lower base 21, providing a force-resisting stop and enhancing overall structural stability.

Figure 18:
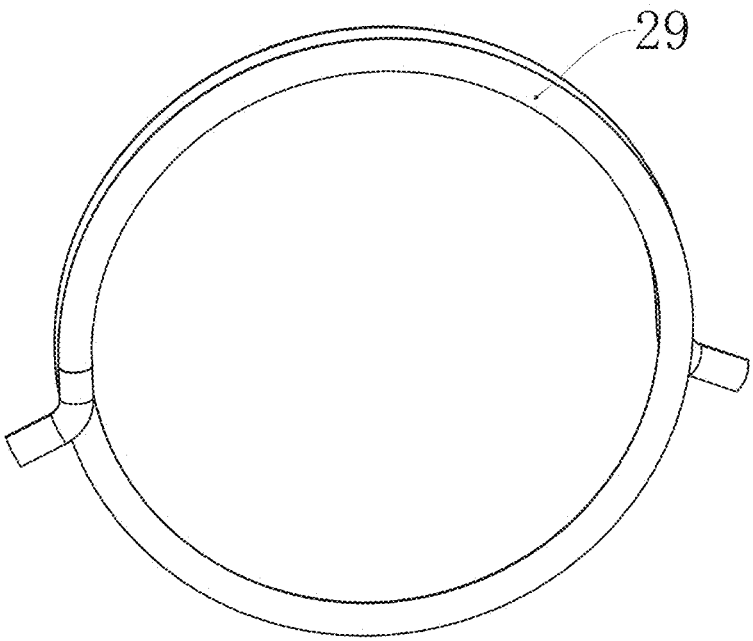
FIG. 18 is a perspective view of the retaining spring in an embodiment of the present disclosure.

As shown in combination with FIG. 18, a plurality of retaining springs 29 are provided in this embodiment. The plurality of lower connecting rods 22 are designed as square tubes, and correspondingly, the plurality of connecting arms 25 are also designed as a square tube structure. Each retaining spring 29 abuts against the sidewall of the lower connecting rod 22 at a diagonal position and can only be inserted into the lower connecting rod 22 in one direction. Specifically, along the longitudinal direction of the lower connecting rod 22, the retaining spring 29 can only be inserted from bottom to top. When attempting to insert it from top to bottom, the two ends of the retaining spring 29 will abut against the inner wall of the lower connecting rod 22, thereby forming a one-way limit, and preventing the retaining spring 29 from moving downward. In this way, after the retaining spring 29 is inserted into the lower connecting rod 22 from bottom to top, the lower end of the return spring 27 can abut against the retaining spring 29 to limit the position, thereby avoiding the need to form holes on both sides of the lower connecting rod 22 and/or on both sides of the connecting arm 25, thereby improving the overall aesthetics of the structure.

Similarly, in other embodiments, each retaining spring 29 can also be inserted from bottom to top inside the connecting arm 25 to achieve the function of limiting the return spring 27 without forming holes on both sides of the connecting arm 25. In other embodiments, each lower connecting rod 22 can be designed as a round tube or an oval tube, and the retaining spring 29 abuts against the side wall of the lower connecting rod 22.

Figure 15:
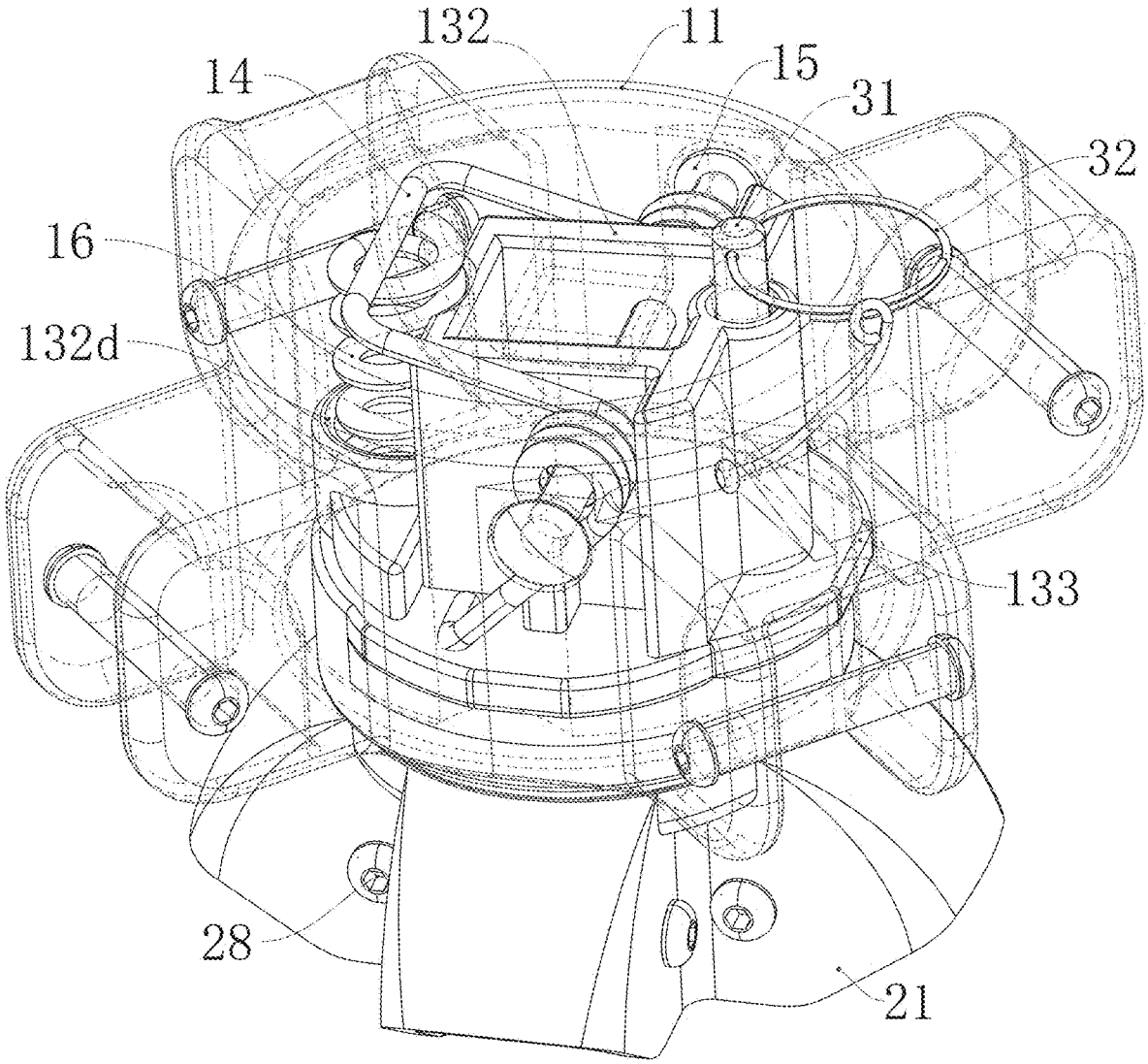
FIG. 15 is a perspective view of the rocking chair frame with the upper cover removed in another embodiment of the present disclosure.
Figure 16:
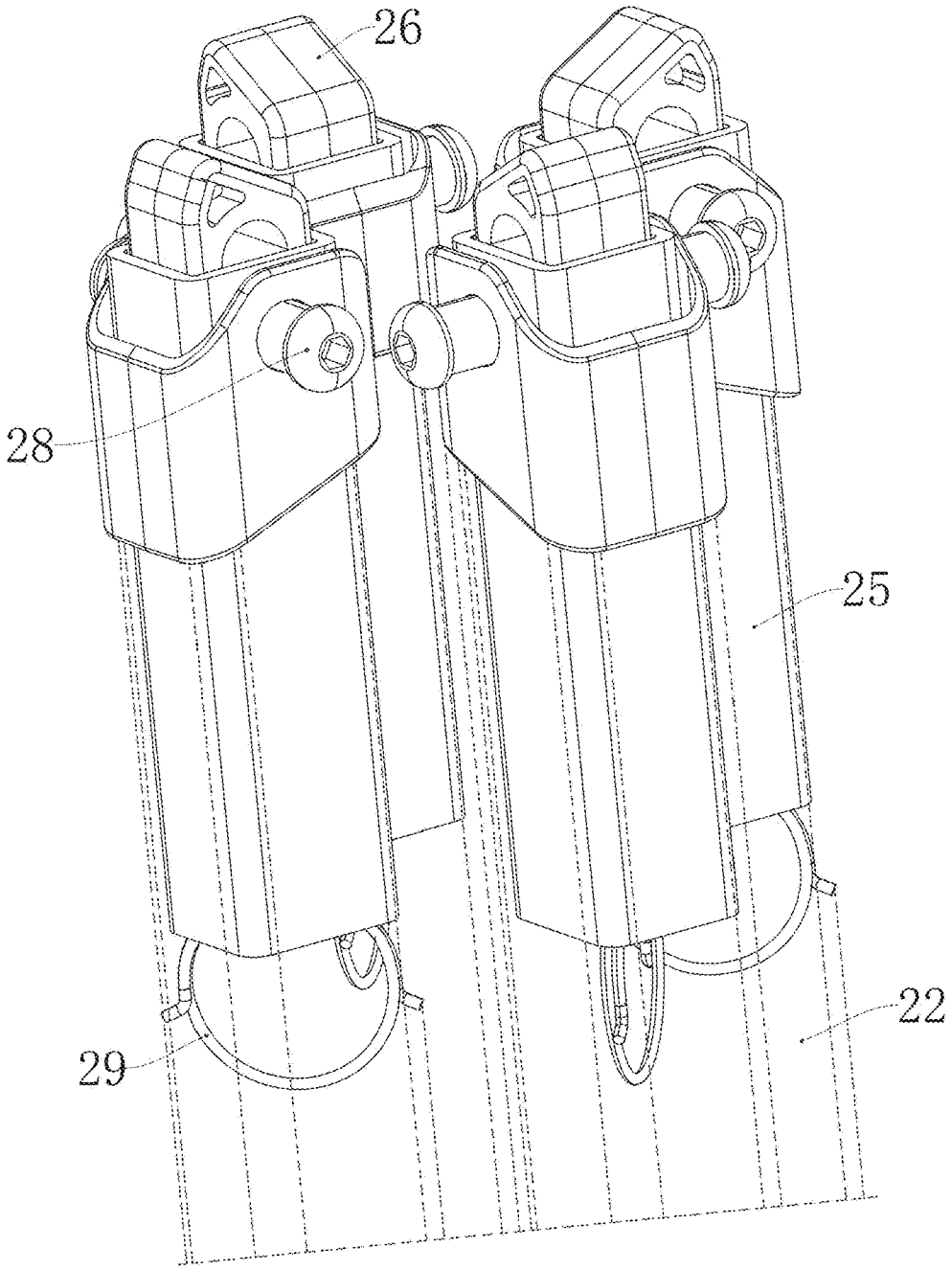
FIG. 16 is a perspective view of the lower connecting rods in another embodiment of the present disclosure.
Figure 17:
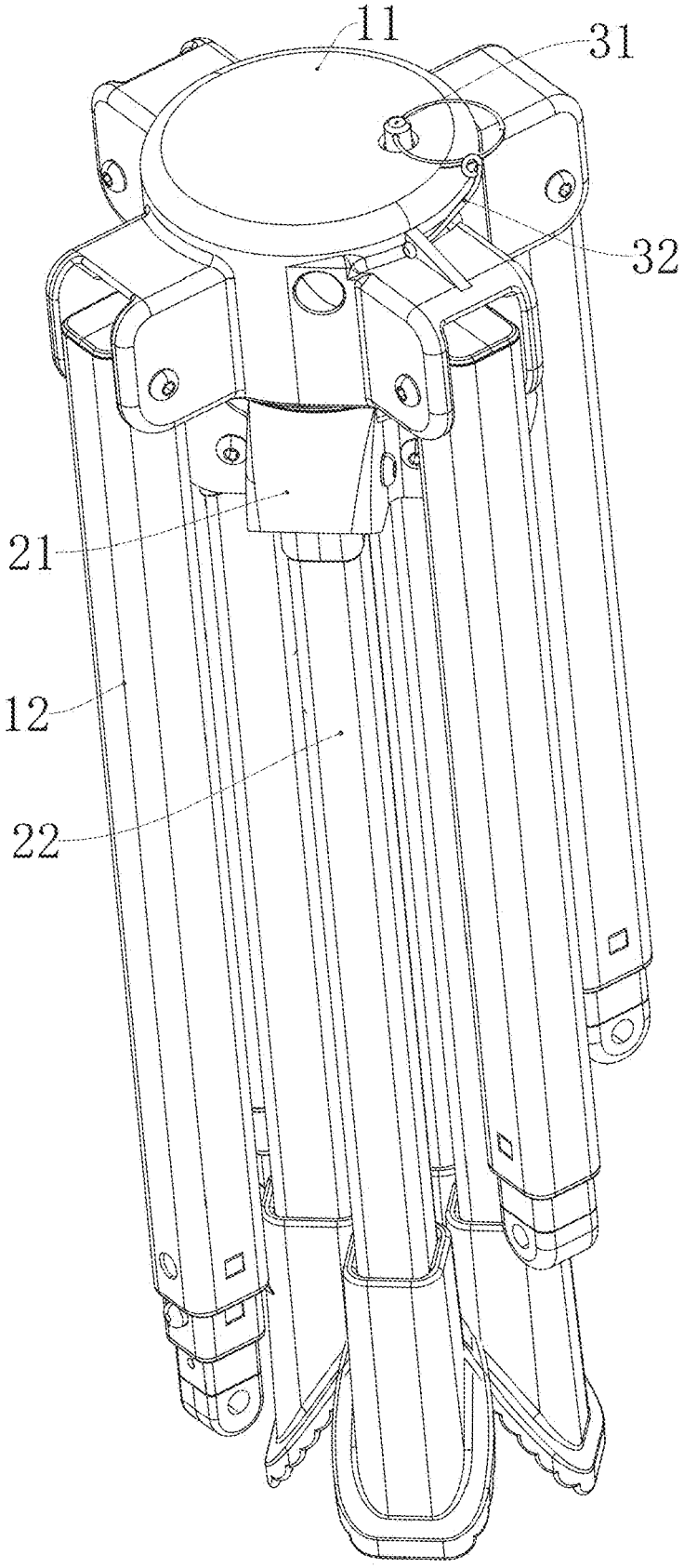
FIG. 17 is a perspective view of a folded rocking chair frame in another embodiment of the present disclosure.

As shown in combination with FIGS. 15-17, in another embodiment, a mounting groove 132*d* is provided on the upper base 13. The mounting groove 132*d* is located on one side of the support column 132 away from the second keyhole 132*b* and is used to mount a helical spring 16. The lower end of helical spring 16 is embedded in mounting groove 132*d*, while the upper end acts on the top wall 11*a* of the upper cover 11. The helical spring 16 and the torsion spring 14 work together to urge the upper cover 11 back to the horizontal position, thereby providing stronger support for the upper cover 11.

Method of operation:

When using the folding rocking chair, the lower support assembly 20 is first unfolded, and the four lower connecting rods 22 are fixed in a supporting position by the limiting members 26. The upper support assembly 10 is then unfolded, and the upper connecting rods 12 support the chair fabric (not shown), forming a load-bearing seat structure. If a user wishes to keep the chair stationary, the pin of the locking device 30 is inserted into the through-hole formed between the upper cover 11 and the upper base 13 in order to keep the upper cover 11 horizontal and prevent it from swinging. If the user wishes to switch to a rocking chair mode, the locking device 30 is unlocked, and the torsion spring 14 allows the upper cover 11 to swing back and forth between a horizontal position and a lower swing position. The user can achieve a rocking motion by applying slight gravity or an external force. After use, the upper connecting rods 12 and lower connecting rods 22 are folded in sequence, and the limiting members 26 are inserted into the positioning portions 21*d* of the lower base 21. The entire structure is folded up for convenient storage and portability.

In another embodiment, a folding rocking chair is disclosed. The rocking chair also includes a seat fabric mounted on the folding rocking chair frame. Specifically, the four corners of the seat fabric are connected to the upper ends of four upper connecting rods 12. To fold the rocking chair, the four lower connecting rods 22 are first retracted and folded downward. Then, the upper support assembly 10 is rotated, and the four upper connecting rods 12 are retracted, so that they are positioned between two adjacent lower connecting rods 22. Finally, the four upper connecting rods 12 are folded downward, staggering the upper connecting rods 12 with the lower connecting rods 22.

In the description of the present disclosure, it should be understood that the terms "center", "longitudinal", "lateral", "length", "width", "thickness", "up", "down", "front", "back", "left", "right", "vertical", "horizontal", "top", "bottom", "inside", "outside", "clockwise", "counterclockwise", "axial", "radial", "circumferential", etc., indicating the orientation or position relationship, are based on the orientation or position relationship shown in the accompanying drawings, and are only for the convenience of describing the present disclosure and simplifying the description. Those terms do not indicate or imply that the device or elements referred to must have a specific orientation, and must be constructed and operated in a specific orientation. Therefore, those terms cannot be understood as a limitation on the present disclosure.

Furthermore, the terms "first" and "second" are used for descriptive purposes only and should not be construed as indicating or implying relative importance or implicitly specifying the number of the technical features being referred to. Thus, a feature specified as "first" or "second" may explicitly or implicitly include at least one such feature. In the description of the present disclosure, "plurality" means at least two, such as two or three, unless otherwise specifically defined.

In the present disclosure, unless otherwise expressly specified or limited, a first feature being "above" or "below" a second feature may mean that the first and second features are in direct contact, or that the first and second features are in indirect contact through an intermediate medium. Furthermore, a first feature being "above", "over", or "on top of" a second feature may mean that the first feature is directly above or diagonally above the second feature, or simply means that the first feature is at a higher level than the second feature. A first feature being "below", "under", or "underneath" a second feature may mean that the first feature is directly below or diagonally below the second feature, or simply means that the first feature is at a lower level than the second feature.

Although the embodiments of the present disclosure have been shown and described above, it can be understood that the above embodiments are illustrative and cannot be understood as limitations on the present disclosure. A person having ordinary skill in the art can make changes, modifications, substitutions, and variations to the above embodiments within the scope of the present disclosure.

What is claimed is:

1. A folding rocking chair frame, comprising:

an upper support assembly, comprising an upper cover, an upper base, and a plurality of upper connecting rods, one end of each of the plurality of upper connecting rods being connected to the upper cover and rotatable relative to the upper cover, the upper cover being swingable back and forth relative to the upper base between a horizontal position and a lower swing position;

a lower support assembly, comprising a lower base and a plurality of lower connecting rods, one end of each of the plurality of lower connecting rods being connected to the lower base and rotatable relative to the lower base, the upper base being connected to the lower base;

a locking device configured to connect the upper cover to the upper base in a locked state, so as to maintain the upper cover in the horizontal position and restrict back and forth swinging, and to allow the upper cover to swing back and forth relative to the upper base in an unlocked state.

2. The folding rocking chair frame according to claim 1, wherein: the upper cover is provided with a first keyhole, the upper base being provided with a second keyhole at a position corresponding to the first keyhole, when the upper cover is in the horizontal position, the first keyhole is aligned with the second keyhole, and the locking device is insertable into a through-hole formed by the first keyhole and the second keyhole to complete locking.

3. The folding rocking chair frame according to claim 2, wherein: the first keyhole is provided in a top wall or an outer circumferential surface of the upper cover; and/or a torsion spring and/or a helical spring are provided between the upper cover and the upper base, the torsion spring and/or the helical spring having an elastic force that urges the upper cover to spring back to a horizontal state.

4. A folding rocking chair, comprising the folding rocking chair frame claimed in claim 3.

5. The folding rocking chair frame according to claim 2, wherein: the locking device comprises a locking member and an anti-lost rope, the locking member being configured to be insertable into the through-hole formed by the first keyhole and the second keyhole, the anti-lost rope being configured to secure the locking member to the upper support assembly or the lower support assembly.

6. A folding rocking chair, comprising the folding rocking chair frame claimed in claim 5.

7. A folding rocking chair, comprising a chair fabric and the folding rocking chair frame claimed in claim 2.

8. The folding rocking chair frame according to claim 1, wherein: a plurality of limiting members are elastically mounted on a respective one of ends of the plurality of lower connecting rods proximal to the lower base, each of the plurality of limiting members being reciprocally movable along a longitudinal direction of a respective one of the plurality of lower connecting rods, the lower base being provided with a plurality of positioning portions, when the plurality of lower connecting rods are in a folded state relative to the lower base, each of the plurality of limiting members is inserted into a respective one of the plurality of positioning portions, thereby providing resistance to rotation of the plurality of lower connecting rods relative to the lower base.

9. The folding rocking chair frame according to claim 8, wherein: a plurality of retaining springs are provided inside a respective one of the plurality of lower connecting rods and are movable unidirectionally along longitudinal directions of the plurality of lower connecting rods, a plurality of return springs being provided between respective ones of the plurality of retaining springs and the plurality of limiting members, one end of each of the plurality of return springs being abutted against a respective one of the plurality of retaining springs, and another end being abutted against a respective one of the plurality of limiting members; or a plurality of connecting arms are nested within a respective one of the plurality of lower connecting rods, each of the plurality of limiting members being slidable along a respective one of the plurality of connecting arms in its longitudinal direction, a plurality of unidirectionally movable retaining springs being provided inside a respective one of the plurality of connecting arms, a plurality of return springs being provided between respective ones of the plurality of retaining springs and the plurality of limiting members, one end of each of the plurality of return springs being abutted against a respective one of the plurality of retaining springs, and another end being abutted against a respective one of the plurality of limiting members.

10. A folding rocking chair, comprising the folding rocking chair frame claimed in claim 9.

11. A folding rocking chair, comprising the folding rocking chair frame claimed in claim 8.

12. The folding rocking chair frame according to claim 1, wherein: a stop portion having a height difference between a highest point of the stop portion and a lowest point of the stop portion is provided at an upper end of the upper base, when the upper cover is in the horizontal position, a gap His formed between a top wall of the upper cover and the lowest point of the stop portion, thereby reserving a space for the upper cover to swing back and forth.

13. A folding rocking chair, comprising the folding rocking chair frame claimed in claim 12.

14. The folding rocking chair frame according to claim 1, wherein: the upper base and the lower base are connected by a vertically disposed connecting bolt, and the upper base is rotatable relative to the lower base around the connecting bolt.

15. A folding rocking chair, comprising the folding rocking chair frame claimed in claim 14.

16. The folding rocking chair frame according to claim 14, wherein: a shouldered bushing is provided at a top portion of the lower base, the shouldered bushing being fixed circumferentially relative to the lower base, and in contact with a bottom portion of the upper base, so as to allow the upper base to rotate around the connecting bolt.

17. A folding rocking chair, comprising the folding rocking chair frame claimed in claim 16.

18. A folding rocking chair, comprising the folding rocking chair frame claimed in claim 1.

* * * * *